United States Patent [19]

Hirmann et al.

[11] 4,216,469

[45] Aug. 5, 1980

[54] ALARM SYSTEM FOR DETECTING CHANGES IN LOAD ON TERRAIN

[75] Inventors: Georg Hirmann; Bruno Kagi, both of Zurich, Switzerland

[73] Assignee: Multisafe AG, Schaan, Liechtenstein

[21] Appl. No.: 889,840

[22] Filed: Mar. 24, 1978

Related U.S. Application Data

[62] Division of Ser. No. 807,132, Jun. 16, 1977.

[30] Foreign Application Priority Data

| | | | |
|---|---|---|---|
| Jun. 23, 1976 | [CH] | Switzerland | 8013/76 |
| Mar. 17, 1977 | [CH] | Switzerland | 3376/77 |
| May 16, 1977 | [CH] | Switzerland | 6052/77 |

[51] Int. Cl.[2] ..... G08B 13/10

[52] U.S. Cl. ..... 340/666; 116/70; 200/61.93; 200/86 R

[58] Field of Search ..... 340/666, 626; 116/70, 116/65; 200/83 A, 83 J, 61.93, 86 R, DIG. 5

[56] References Cited

U.S. PATENT DOCUMENTS

| | | | |
|---|---|---|---|
| 2,641,689 | 6/1953 | Poitras | 116/65 |
| 3,719,939 | 3/1973 | Geil et al. | 340/626 |
| 4,055,844 | 10/1977 | Hornbostel, Jr. | 340/626 |
| 4,091,370 | 5/1978 | Swanda | 340/666 |

*Primary Examiner*—Glen R. Swann, III

*Attorney, Agent, or Firm*—Finnegan, Henderson, Farabow, Garrett & Dunner

[57] ABSTRACT

A system for detecting changes in load on terrain and actuating an alarm in response thereto including a fluid system, a pressure-sensitive device in the fluid system having a first pressure signal output responsive to a load on a terrain, a second pressure signal output generating device responsive to said first pressure signal output, an alarm and a pressure-sensitive switch connected to said alarm, said switch being responsive to the second pressure signal output to actuate the alarm.

10 Claims, 10 Drawing Figures

ALARM SYSTEM FOR DETECTING CHANGES IN LOAD ON TERRAIN

CROSS-REFERENCE TO RELATED APPLICATION

This is a division of application Ser. No. 807,132 filed June 16, 1977.

BACKGROUND OF THE INVENTION

The present invention relates to an alarm system for detecting changes in load on terrain and more particularly to an alarm system containing a pressure-sensitive switch and a mat containing a flexible element in which a change in volume caused by external action on the mat is detected by the switch. Various alarm systems are known in which an odd event or an event at an odd time on a given part of the terrain triggers an alarm or a display signal.

These systems comprise pressure pick-ups arrayed in a conventional manner, whereby the number of pressure pickups provided determines the effectiveness of the system. The pickups generally act individually in an electrical, mechanical electronic or pneumatic manner on a signal-processing system that carrys out the desire processing of the signals. Such systems are used mostly to protect spaces, buildings, fenced-in lots and fences or gates. Because of the restricted radii of detection of such sensors, any change in their location requires a thorough study of the greatest probability and danger of the expected odd events. Furthermore, an unavoidable drawback is that such alarm systems can be set up only with a predictable probability of success and may be fairly easily circumvented once their array is known.

An effective and reliable alarm system must be such that (1) it is practically uncircumventable,
(2) it evidences high sensitivity to changes in load under all atmospheric conditions,
(3) it responds only to transiently effective changes in load, not only once, but reversibly, and
(4) gradual changes in environmental factors, for instance local changes in the weight of the soil above or temperature variations, remain ineffective.

These requirements are in part contradictory. Thus, an extension of the sensitive zone also must cause a volume increase in the sensor. The relative change in volume and the change in pressure corresponding thereto, to which the signal processing system will respond, will, of course, be smaller, as the sensitive zone of the sensor becomes larger. Thus, the sensitivity of detection decreases.

One of the most progressive and advanced solutions to date has been suggested in the German Offenlegungsschrift No. 2,040,762 or U.S. Pat. No. 3,719,939. Two flexible tubes filled with an incompressible medium and spaced apart are buried in the terrain to be protected. A converter or transducer, that senses the disturbance acting on a particular medium-filled tube, is connected to each. A distance disturbance or a change in the environment as well as a pressure applied equally to both tubes affects each tube similarly in a two-tube system, resulting in a null signal in a balancing circuit at the transducer output. Only if there is a local disburbance affecting only one of the tubes, does the balancing circuit emit an electrical output signal which is a function of the pressure difference between the two tubes.

This signal is available to trigger an alarm indicating unauthorized penetration of the bounded area.

This system meets only a few of the above requirements and suffers from the essential drawback that such sensors offer a reliable barrier only if laid down in high density; this is so because the changes in load due to an intruder are short-range because of the soil bridging the buried tubes and furthermore they become wholly inoperative if this soil freezes.

Even though this detection system acts differentially through a differential-pressure transducer, it is subject to long term or permanent deviations on account of slow, locally varying loads or temperature fluctuations. The signal may be reset electrically, but not mechanically, to the initial position, and this may lead to overloading of the pick-up, at least to decreasing its sensitivity. In any event, the pick-up must be designed for fairly high pressure differences, and this means an inherent loss in sensitivity.

SUMMARY OF THE INVENTION

The requirement for a large area sensor with simultaneous high sensitivity in the presence of load changes is met according to the present invention by using a mat made from a flexible material, but of least possible elasticity, containing communicating, inflatable and relatively dimensionally stable channels between which are located inactive surfaces or spaces and in which the inflated channels are covered at least on their upper side with a continouous and flexible bridging plate or sheet.

Whenever there is a change in load within the area covered by the mat, even if the loaded area should be of minimal dimensions, the force will be transmitted by the bridging plate or sheet to all channels spanned by the sheet. There can be therefore no local pinching, as is the case for a single hose or channel, preventing further pressure increase in that hose. The bearing surface of these channels is less than 10% of the overall surface, and on account of their minor cross-section and volume, a large change in pressure is created despite this force distribution. It is important that the mat material lack any significant elastic stretching, so that the circular shape of the channels cross-section be largely retained even when excess pressure is applied to these channels. The characteristic line of the pneumatic spring action is thereby made progressive, that is, the bearing force of the channels increases steeply with load. The flexure of the cover plate or sheet at the site of loading therefore remains small and within admissible limits.

If there were no cover plate, the inactive areas of the mat would be completely embedded in the soil and bridges would form over the individual channels. A change in load then could not spread fully, as is the case for individually laid channels, and certainly not at all when the soil is frozen.

The cover plates form bridges with large support spacings, allowing flexure of the earth above upon load, even if said earth is highly compacted or frozen. This load is transmitted in this manner nevertheless to the mat.

DETAILED DESCRIPTION OF THE INVENTION

Figure 1:
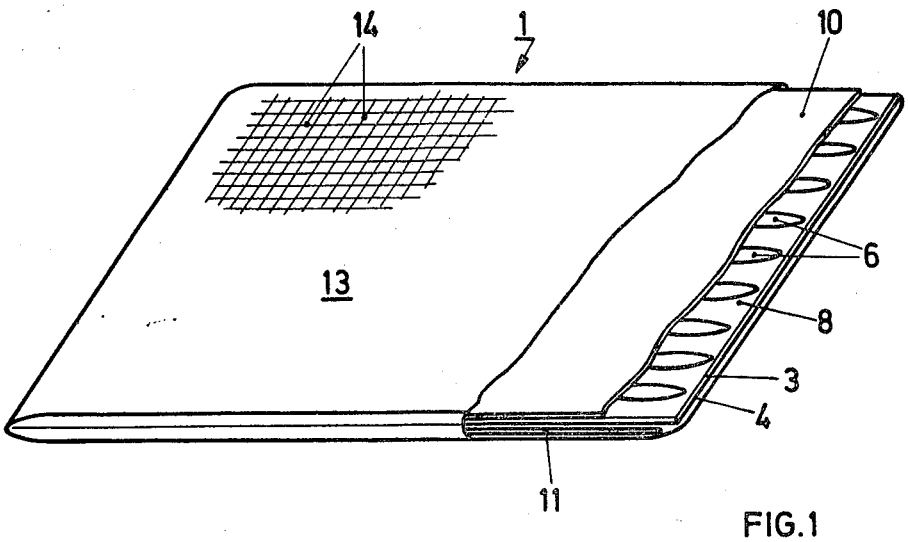
FIG. 1 is a perspective view of a mat constructed in accordance with the present invention with parts broken out for clarity.
Figure 2:
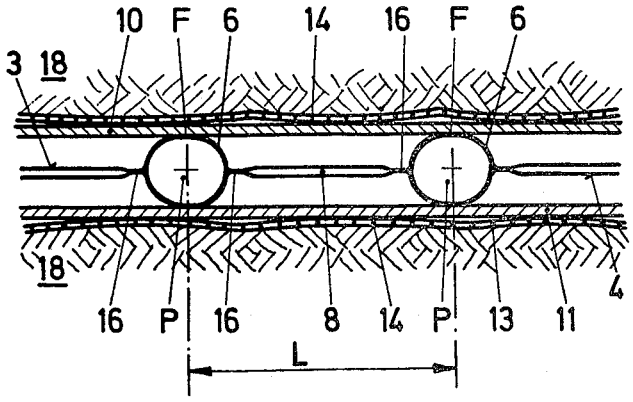
FIG. 2 is an enlarged cross-sectional view of the mat of FIG. 1.

FIGS. 1 and 2 show a mat 1 in an embodiment suitable for practical applications. Two flexible sheets 3 and 4, for instance plastic foils reinforced with nylon or glass fibers, are provided as the core of the mat and are so connected to one another that communicating, inflatable channels 6 are formed between inactive areas 8 by the two sheets. Continuous plates 10 and 11, which also may be made of plastic, are mounted in sandwich form on either side of structures 3, 4 determining the inflatable part of mat 1. A sleeve 13 reinforced for instance by means of fiberglass 14, encloses the whole. Such mats are fully operative even at extreme temperatures (−30° to +50° C.).

FIG. 2 shows a section of the mat of FIG. 1, which is buried in ground 8. It is seen that the two structures 3 and 4 are held together by connecting seams 16, inflatable channels 6 being determined by the position of said seams 16. Inactive areas 8 furthermore are located between channels 6. Channels 6 are inflated for instance by means of compressed air. "P" representing the pressure in the channels. "F" represents the surface area of channels 6 in contact with plate 10. These channels for the ready position being compressed by ground 18 resting on plate 10 until the sum of all F.P equals the weight of ground 18 and of plate 10. The more channels 6 are apart, that is, the larger "L", and the more ground 18 between these two channels 6 and the higher the selected pressure must be in said channels. Thus, channels 6 must be constructed to bear the load.

If now plate 10 is loaded additionally, for instance, if someone steps on ground 18, pressure P in channels 6 will increase correspondingly; surfaces "F" also increasing somewhat. This process takes place impulsively and lasts only until the static equlibrium is reestablished. Thus, plate 10 (together with plate 11 as support) acts as aload transmitter because the support area for ground 18, plate 10, is supported by an area (sum of all F) which is appreciably smaller than the real extent of structures 3, 4. This secures a high pressure in channels 6, that is, the pressure is in such ranges where evident deviations are obtained at the pressure measuring site. The sudden manifestation of the weight of a human being, or of fractions of such weight, therefore causes a corresponding increase in pressure in channel 6.

Figure 3:
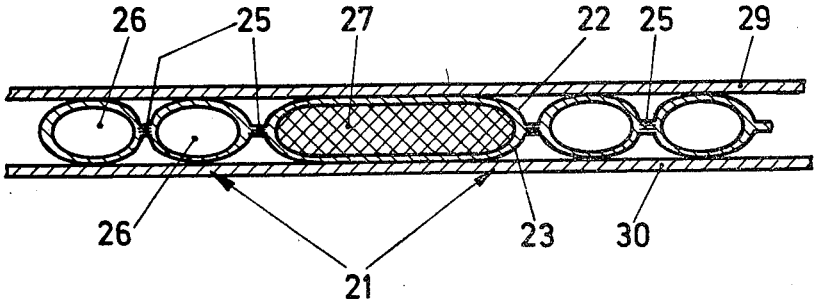
FIG. 3 is a view similar to FIG. 2 showing another embodiment of the mat.

FIG. 3 shows an embodiment similar to that of FIG. 2, wherein a mat 21 with two structures 22 and 23 is joined by connecting seams 25 to form channels 26. As shown, an inactive zone 27 is provided between two channels 26 which, contrary to the embodiment of FIG. 2, is filled with a soft material, for instance, open-pored foam rubber. The purpose of the filling is to prevent any penetration of the earth into this region. Again, these interconnected structures 22 and 23 are sandwiched between two plates or sheets 29 and 30.

Figure 5:
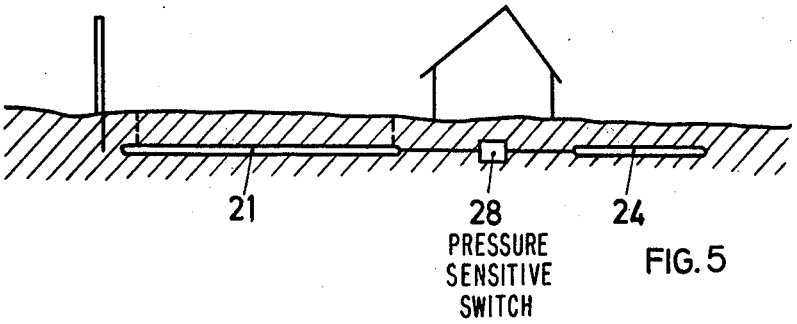
FIG. 5 is a schematic illustration of the manner in which the mats according to the present invention are laid out in the land.

When used as alarms, the pressure mats are laid out in the land to be secured as shown in FIG. 5. Preferably, they will be buried, possibly being protected against mechanical damage by elastic protective means such as foils or wire mesh. If the ground is already supportive in thin layers, for instance when frozen, then care must be taken that those parts of the ground covering pressure mats 21, 24 do not become rigid bridges capable of absorbing additional loading without the pressure mats being affected.

To optimally monitor the peripheral sectors of a lot of land, it may be advantageous to provide pressure mats 1 at their peripheries with inactive, elastic rim segments 27 (FIG. 6), which may be filled with a springy material, for instance foam, to the same thickness as the inflated pressure mats. These inactive peripheral segments do not participate in the mat's pressure indication. But, said peripheral segments must not be so compressible that both foils of the mat touch. The foam may be replaced by compressed air. The result is that those parts acting as anchors of the mats are moved out of the range to be monitored, so that even the peripheries of the active pressure mats remain sensitive.

Figure 6:
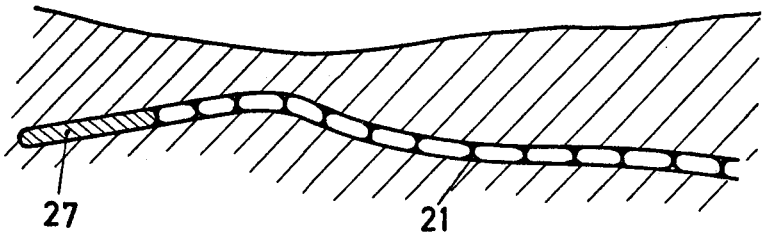
FIG. 6 is an enlarged illustration similar to FIG. 5 and further showing the mounting for periphery of the mat.

FIG. 6 shows peripheral inactive segment 27 mounted to the edge and makes it clear that the pressure mat may be emplaced in the ground in a manner that conforms to the contour of the land. Therefore, there is no need whatever to emplace the pressure mat horizontally, which represents a great advantage in rocky or sloping grade. As long as no kinks occur, the pressure mat may be emplaced without the need for leveling the terrain. To prevent excessive bending loads on the cover plates as might be due for instance to sharp stones or sharp terrain irregularities, it may be advantageous to spread plastic granulate on the mat bedding (not shown). The cover plates also may be appropriately so divided as to easily fit the terrain features.

In this manner, it is possible, for instance, to create alarm systems insensitive to environmental factors and to protect optimally the secured lots regardless of operational cost. The insensitivity to environmental factors is achieved by connnecting the mat pairs in balanced manner.

This pressure mat offers another advantage because it lends itself to being manufactured practically as a large component, furthermore being easily stored in rolls, and allowing it to be welded together in situ into final shape according to particular requirements. It may be very advantageous in some applications to arrange several pressure mats one underneath the other and to adjust in this manner the various installations to various sensitivites, for instance, one set to respond to pedestrians at night and another to vehicles by day. Each set would be accordingly switched off.

It has been shown above how the mats of the invention meets the first two of the above four listed requirements. The last two relate to the manner of pickup response to changes in loads. These latter requirements are that only transiently effective changes in load be recorded, and that slow changes in environmental factors do not adversely affect the pickup's sensitivities.

A significant contribution to the solution of this problem consists in the initially cited and already previously known comparison with a second, unaffected volume subject to similar environmental conditions by means of measuring differential pressure. This proposal, however, is insufficient, because, as already mentioned before, permanent changes in load and temperature in one of the two volumes being compared may cause a permanent shift in the null of the pressure sensor. Such permanent changes furthermore prohibit the use of a highly sensitive pressure pickup.

This difficulty is eliminated by the invention in that the compensating second system, which is operationally connected with the first sensing one through a pressure-differential sensor, is connected in parallel with this last sensor directly through a throttling point, whereby a slow pressure balance is possible between the two coupled systems.

In this manner, only rapid changes in pressure are detected. Any gradual or permanent deviation in the environmental conditions of the sensors is compensated, that is, there is automatic reset of the null point of the differential-pressure sensor.

Figure 4:
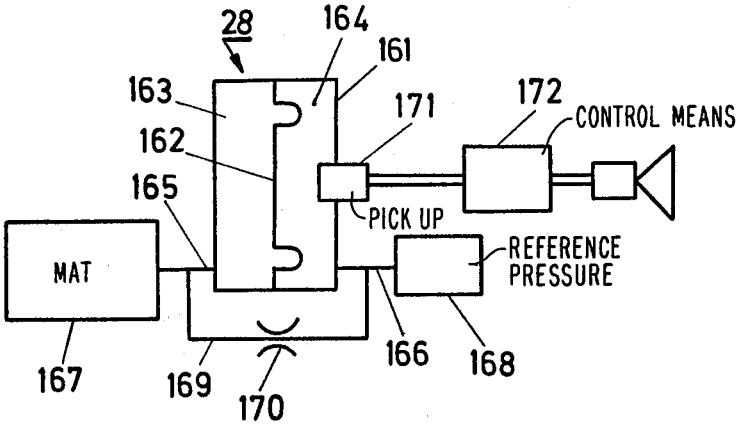
FIG. 4 is a diagrammatic illustration of the differential pressure switch for use with the mat hereof.

FIG. 4 shows in illustrative manner a differential-pressure switch 28 provided with a housing 161 and a membrane 162 separating two pressure chambers 163 and 164. Said pressure chambers are connected through lines 165 and 166 with sensing mat 167 and with the non-affected comparison volume 168. A line 169 with a throttling point 170 connects the two pressure chambers. Suddenly occuring load changes above mat 167 cause a rise or drop in pressure in chamber 163 and a deflection of membrane 162 which triggers an alarm by means of a pickup 171 shown symbolically and a control system 172.

The behavior of the signal generator system depends on the type of filling medium used. A compressible gas behaves differently than an incompressible liquid, especially when the sensor is made of a material with low stretching properties.

When using a liquid, even a small displacement of the membrane of the pressure difference detector causes a corresponding increase in pressure in the comparison volume. If the pressurizing medium is a liquid, it is appropriate therefore to mount a gas buffer in the comparison volume. This considerably increases the sensitivity of the signal generator, i.e., its response.

Figure 7:
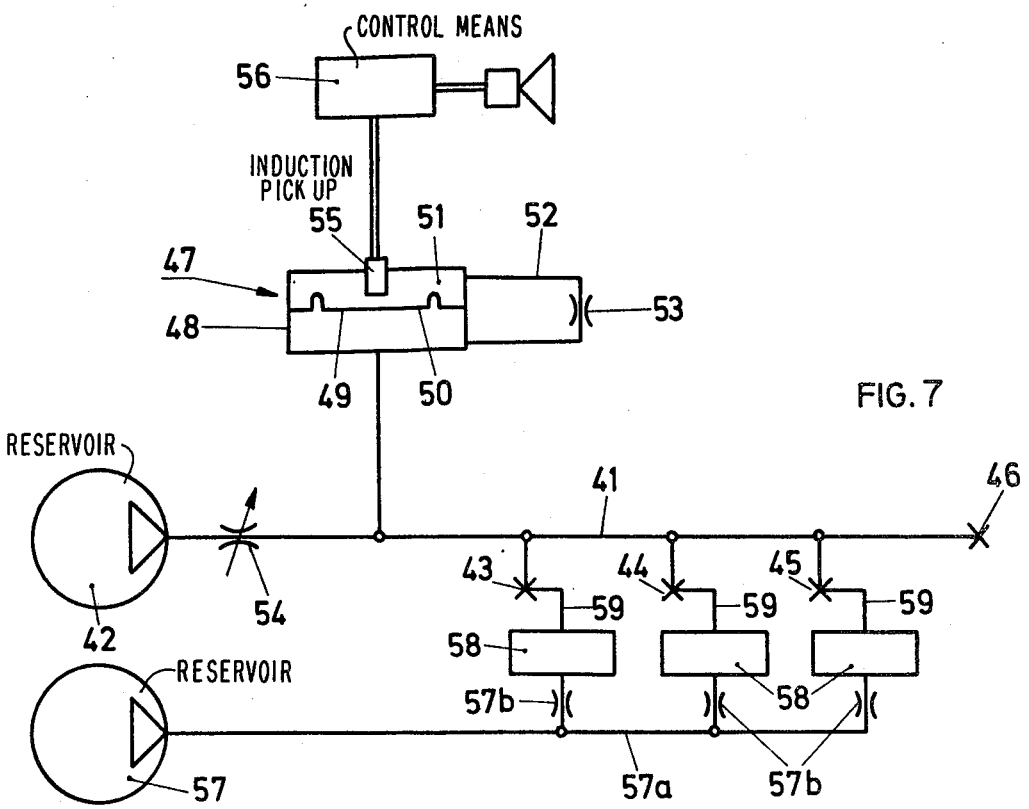
FIG. 7 is a diagrammatic illustation of one embodiment of the alarm system of the present invention.

It is frequently desired to eliminate the placement of electrical lines and the use of electrical transducers for the detectors associated with the sensors, that is, to operate the alarm system pneumatically outside the monitoring station. This problem too can be solved as follows:

FIG. 7 shows an alarm pressure line 41 fed from a pump or a pressure reservoir 42. Line 41 is equipped with opening and closing gates 43, 44 45 and 46 (for instance valves), the position of which (open or closed) acts on pressure-differential switch 47. This switch 47 comprises a housing 48 and a membrane 49 separating two pressure chambers 50 and 51. Said pressure chambers are connected through a line 52 and a throttling point 53. An appropriate and corresponding balancing orifice in the membrane may also be provided as the throttle point 53.

The sensors opening their associated gates 43, 44 or 45 upon changes in load, in particular increases in load, are for instance mats 58 of which the design has been discussed in detail above. Mats 58 are filled with a pressurized medium and operationally connected to the gates through control lines 59 in such manner that for instance upon a sudden change in the load upon mat 58, a first pressure signal ouput is generated which opens its associated gates 43–45. Thereupon the equally sudden drop in pressure in the alarm pressure line 41 generates a second pressure signal output which causes switch 47 to respond and the alarm is triggered.

Mats 58 are connected through throttling points **57*b* and a supply line 57*a* with a pressure reservoir 57** ensuring that the pressure in the mats corresponds to the reference or rated value.

The median pressure in line 41 is predetermined and constant. Any leakage losses are compensated by the supply from a pressure reservoir 42. The medium pressure in pressure chambers 50 and 51 of switch 47 is the same. When at least one of gates 43–46 is opened, the median pressure in line 41 and in chamber 50 drops impulsively because a throttle point 54 prevents rapid refilling with air of line 41. Because for a moment there is still the original, higher pressure in chamber 51, membrane 49 moves toward the lower pressure, whereupon an illustratively and symbolically represented induction pickup 55 triggers an alarm through a control system 56. A pinch-cock or a snap valve also may be used as a gate.

Instead of actuating an induction pickup 55, the membrane motion may also be used to open a gate element in an air line from chamber 51 to a siren, the replenishing of air occurring from reservoir 42. Such a system has no electrical components.

Figure 8:
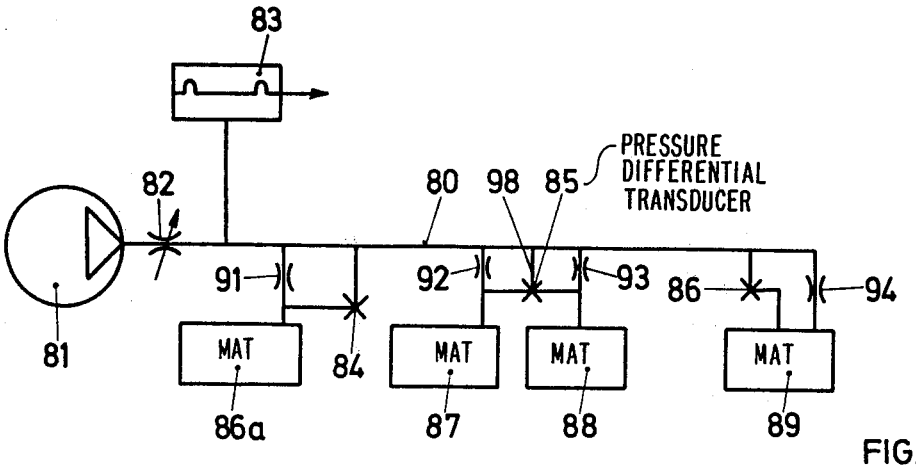
FIG. 8 illustrates another form of the alarm system.

FIG. 8 shows an alarm pressure line 80 fed from a pressure reservoir 81 through a throttling point 82. A pressure switch 83 monitors the pressure. Gates in the form of pressure-differential transducers 84, 85 and 86 upon cause for alarm may be opened by pneumatic pressure pickups 86a, 87, 88, 89, whereupon the pressure will suddenly drop in line 80.

The schematic shows the feasibility of directly feeding such penumatic pickups **86*a*–89 by means of the alarm system. The individual throttling points 91, 92, 93, 94** are used to that end, allowing compensation for any leakage losses in the sensors, without however, affecting the alarm system so there would be no sudden pressure drop, that is, no pressure impulse in it.

Figure 9:
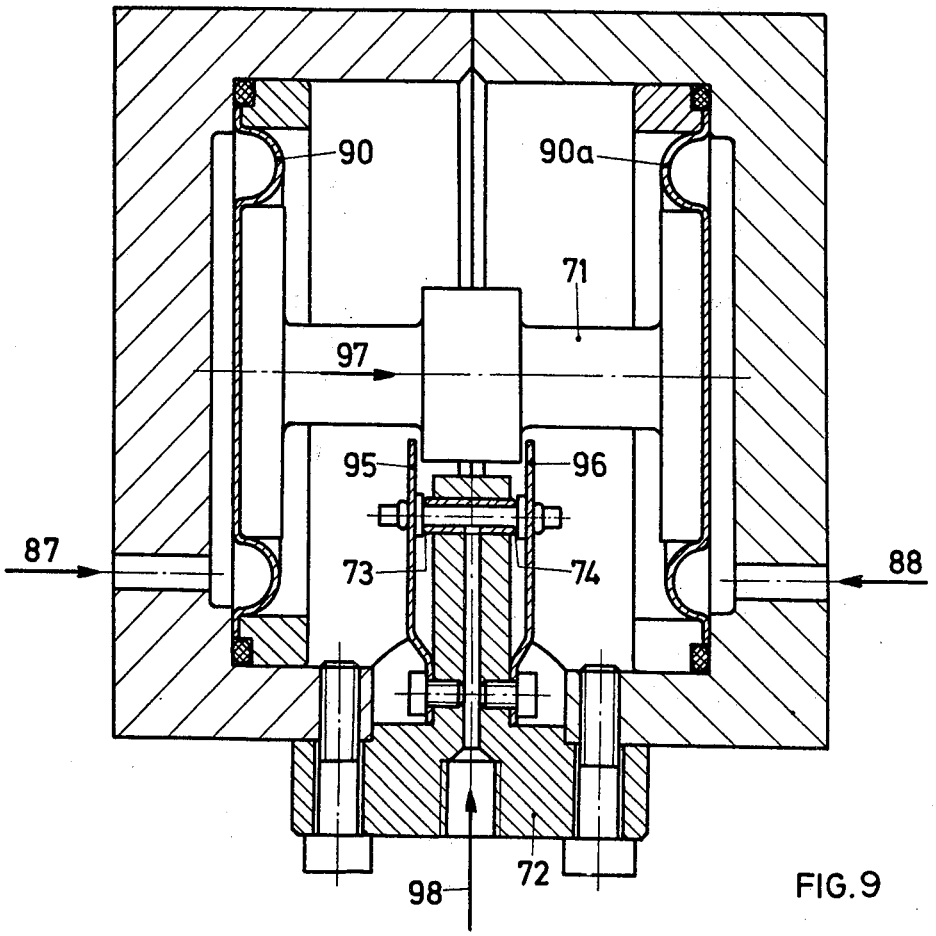
FIG. 9 is a cross-sectional view of a differential pressure transducer for use with the alarm system.

FIG. 9 shows an embodiment of a differential-pressure transducer, for instance of transducer 85 (FIG. 8). The median pressure of equal magnitude applied from sensors 87 and 88 through line 80 and membranes 90, **90*a* upon a floating piston part 71 retain the latter at mid-stroke. A flange 72 is used to connect a connection line 98 to the alarm pressure line 80. The central part of flange 72 is provided with a central borehole and a bush of which the ends are designed as valve seats 73, 74. On these rest elastic valve flaps 95, 96 keeping the passages closed. When excess pressure occurs on membrane 90, the piston part is displaced in the direction of arrow 97 and the valve flap 96 is raised against its spring-bias. This allows the pressure medium to issue at valve seat 74, which causes a sudden pressure drop in the connecting alarm pressure line 80. The same effect is obtained from excess pressure on membrane 90*a* with respect to valve seat 73**.

Figure 10:
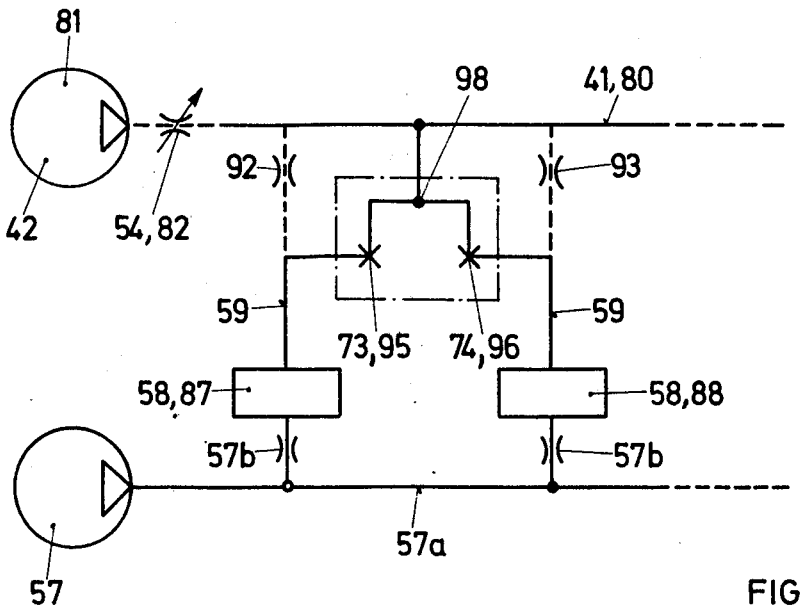
FIG. 10 is a diagrammatic illustration of the differential pressure transducer of FIG. 9 incorporated into a alarm system.

FIG. 10 shows a differential-pressure transducer in the sense of FIG. 9 incorporated for instance into an alarm system of FIG. 7 or FIG. 8. The pressure-differential transducer of FIG. 10 is indicated by the dash-dot line. The most important parts are denoted by the same reference numerals as in FIG. 9. As a first possibility, the installation of FIG. 7 is considered, which comprises the two pickups 58 fed with a pressure medium from their own pressure reservoir 57, whereas alarm pressure line 41 is supplied with its own pressure medium from a second pressure reservoir 42. As described in relation to FIG. 9, the two sensors 58 when loaded act on valve flaps 95 and 96, whereby the pressure medium may escape through valve seats 73 and 74, respectively.

However, it is also possible to incorporate the differential-pressure transducer of FIG. 9 in the sense of FIG. 8. In that case, only a single common pressure reservoir 81 for the actual sensor and the other system is required. As shown, the corresponding connecting lines comprising throttling points 92 and 93 and leading to sensors 87 and 88 are represented by dashed lines.

In lieu of the pneumatic signal transmission from the differential-pressure transducer by means of pneumatic amplification, it is obviously also possible to employ the known and highly sensitive transducers consisting of piezoelectric or semiconducting materials in conjunction with electrical amplifiers or Rheed relays for the pressure detectors.

Such solutions are particularly unavoidable when the alarm system must be installed at an outpost far from the monitoring station. In this case, it is an autonomous system containing a battery-operated transmitter. Again, the system of the invention is outstandingly suited to this purpose. To increase the life of the battery, activation of the installation appropriately will be triggered by the sensor signal itself.

The described monitoring systems, especially those with pneumatic signal transmission, are suited not only for burglar alarms, but also for many other applications:

Thus the described installation may be used for door-opening systems, further for the detection of terrain shifts, slides, and generally to record changes in the densities of ground segments. Again, the sinking of buildings due to subgrade settling may be detected.

External and different types of sensors also may be hooked up, for instance, by means of magnetic valves.

An important field of application of such an alarm system is for fire alarms. To that end, melting orifice gates or self-melting or combustible alarm conduits may be used for instance with pipelines or the like.

In similarly easy manner, dissolving water-alarm gates may be made, for instance, using sugar, salt or the like.

Again, it is possible to hook up independent, battery-operated electrical or electronic sensors by means of electric valves.

Such a combination offers the advantage that at most individual sensors, but not the alarm line itself, can be located magnetically.

What is claimed is:

1. A system for detecting changes in load on terrain and actuating an alarm in response thereto comprising:

a first fluid system, a pressure sensitive device in said first fluid system having a first pressure signal output responsive to a load on the terrain, a second fluid system, means in said second fluid system responsive to said first pressure signal output for generating a second pressure signal output, an alarm, and a pressure sensitive switch connected to said alarm, said switch being responsive to said second pressure signal output to actuate said alarm.

2. A system according to claim 1 wherein said second pressure signal output generating means includes a gate valve for discharging fluid from said second fluid system, said pressure sensitive switch being responsive to a drop in pressure in said second fluid system resultant from the fluid discharge therefrom to actuate said alarm.

3. A system according to claim 1 wherein said pressure sensitive switch includes a reference pressure chamber, a pressure chamber in communication with said second fluid system, a pressure differential sensitive diaphragm separating said chambers one from the other, a passage interconnecting said chambers and a throttling valve in said passage to equalize the pressure in said chambers over long periods of time while enabling said diaphragm to respond to substantially instantaneous pressure differences across the diaphragm.

4. A system according to claim 1 including a reservoir in said second fluid system, and a flow resistant passage between said reservoir and said pressure sensitive switch.

5. A system according to claim 1 including a reservoir in said first fluid system, and a flow resistant passage between said reservoir and said pressure sensitive device.

6. A system according to claim 1, wherein said generating means includes a housing having a floating piston, one side of which is in communication with a pressure sensitive device and the other side with a reference pressure for moving said piston in response to a pressure differential between the opposite sides of said piston, and means in said second fluid system and connected to said piston for discharging fluid from said second fluid system in response to movement of said piston, thereby generating said second pressure signal output.

7. The system of claim 6 including at least a pair of pressure sensitive devices in said first fluid system having passages in communication with said housing on opposite sides of the piston, one of said pressure sensitive devices being the reference pressure for the other pressure sensitive device.

8. A system for detecting changes in load on the terrain and actuating an alarm in response thereto comprising:

a fluid system, a pressure sensitive device in said fluid system having a first pressure signal output responsive to load on the terrain, a second pressure signal output generating device responsive to said first pressure signal output comprising a housing having a floating piston, one side of which is in communication with a pressure sensitive device and the other side with a reference pressure whereby the piston moves in response to a pressure differential between the opposite sides of the piston created by said first pressure signal output, said movement thereby generating said second pressure signal output and a valve in said fluid system connected to said piston for discharging fluid from said system in response to piston movement, an alarm, and a pressure sensitive switch connected to said alarm, said switch being responsive to the decrease in pressure in said fluid system created by movement of a piston to actuate said alarm.

9. The system of claim 8 including at least a pair of pressure sensitive devices, the second of said pair communicating with the other side of the piston so that one of said pressure sensitive devices is the reference pressure for the other pressure sensitive device.

10. The system of claim 9 including a reservoir in the fluid system and a throttling valve between the reservoir and the pressure sensitive device, said throttling valve absorbing gradual changes in pressure in the system over long periods of time while permitting the pressure sensitive device to generate and transmit to the generating means said first pressure signal output in response to instantaneous pressure differences caused by load on the terrain.

* * * * *